US006772536B2

(12) United States Patent
Ely et al.

(10) Patent No.: US 6,772,536 B2
(45) Date of Patent: Aug. 10, 2004

(54) ACCELERATED DEGRADATION EVALUATION METHOD AND APPARATUS

(75) Inventors: Timothy Lynn Ely, Ras Tanura (SA); Rashid Mohammad Al-Othman, Dhahran (SA); Abdul Rahman, Holmfirth (GB); Douglas Patrick Mitchell, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 10/186,132

(22) Filed: Jun. 28, 2002

(65) Prior Publication Data

US 2004/0000066 A1 Jan. 1, 2004

(51) Int. Cl.[7] ..... F26B 7/00

(52) U.S. Cl. ..... 34/380; 34/418; 34/61; 34/201; 73/866; 73/865.8

(58) Field of Search ..... 34/60, 380, 381, 34/329, 343, 201, 418, 61; 73/866, 865.8, 865.6, 76

(56) References Cited

U.S. PATENT DOCUMENTS 4,538,460 A * 9/1985 Schettler, Jr. ..... 73/432
5,396,790 A * 3/1995 Koelliker et al. ..... 73/61.72
5,807,596 A * 9/1998 Angeli et al. ..... 426/233
5,983,711 A * 11/1999 Pappas et al. ..... 73/76
6,227,041 B1 * 5/2001 Collins et al. ..... 73/76
6,250,139 B1 * 6/2001 Klein ..... 73/76

* cited by examiner

*Primary Examiner*—Henry Bennett
*Assistant Examiner*—Camtu Nguyen
(74) *Attorney, Agent, or Firm*—Abelman, Frayne & Schwab

(57) ABSTRACT

An apparatus and method are provided for measuring the physical strength and ability of a solid sample, to resist breakdown into fines after repeated cycles of hydration and regeneration of temperatures in excess of 100° C. The test samples are evaluated using an accelerated degradation apparatus that subjects the sample to a predetermined number of timed cycles of wetting/drying under heat and vacuum, and the weight-percent of any fines produced by the degradation of the sample are measured and recorded after a prescribed number of cycles. Specific values are used for predicting potential useful service life, in years of samples from different commercial manufacturers of the same class of product; the resulting data can be used by manufacturers for more effective quality control of production batches.

10 Claims, 2 Drawing Sheets

10
60
FLUID FEED
80
CONTROLLER
62
40
REFRIGERATOR
WATER CONDENSER
70
RESERVOIR FOR RECOVERED WATER
55
FILTER TRAP
49
VACUUM PUMP
50
21
P GAUGE
20
63
64
23
25
24
22
30
OVEN HEATER

ACCELERATED DEGRADATION EVALUATION METHOD AND APPARATUS

FIELD OF THE INVENTION

The invention relates to the testing and measurement of the resistance to physical breakdown and formation of fine particles of manufactured solid adsorbent materials such as desiccant and catalyst pellets used in industrial dehydration processes.

BACKGROUND OF THE INVENTION

Dehydration processes are used in many industrial applications and are particularly important for liquid and gas hydrocarbon dehydration in the oil and gas industry. Failure of adsorbent and catalyst beds due to physical breakdown of the adsorbent material after repeated regeneration cycles reduces the efficiency and cost effectiveness of the dehydration process in plant operations. Similarly, solid catalyst systems in refining processes can undergo physical breakdown during the process cycle.

This breakdown leads to the formation of fine particles of the solid material or "fines". The continued accumulation of fines results in an excessive pressure drop across the bed and eventually to the necessity for reduced throughput or premature replacement of adsorbent beds.

The current standard quality control test that measures the strength or hardness of molecular sieves, activated aluminas and catalysts pellets is the crush strength test. This crush strength test, in which a force is applied to the solid pellet (held between 2 plates) until the pellet breaks, is not adequate for assessing the potential of the material to resist breakdown into fines in industrial processes.

To date, manufacturers have not developed a standardized test procedure that measures the "physical stability or resistance to breakdown" of an adsorbent material or catalyst in an industrial process. There is no test procedure that measures the ability of a desiccant to resist breakdown into fines when subjected to successive cycles of hot water or aqueous solutions and steam followed by regeneration or a drying cycle. No organization has provided the industry with a standardized test for evaluating this physical property. There is no test that can identify a material that will fail prematurely in service due to premature physical breakdown.

Some research into the effect of adsorption cycles on the physical properties of adsorbents has been undertaken using a column filled with the adsorbent material to be studied. A gas stream, containing a known amount of moisture, is passed through the column until saturation is achieved and this is followed by a drying cycle. Successive cycled of hydration and regeneration are then performed prior to the removal of the adsorbent for evaluation. The recovered adsorbent can then be evaluated by standard physical tests. Unfortunately such testing is very time-consuming and is unable to provide information on the potential of the adsorbent to break into fines during repeated regeneration cycles. No results from studies relating to the physical breakdown and/or resistance to fines formation after repeated regeneration cycles appear to have been published.

It is therefore one objective of this invention to provide an efficient and reliable method and apparatus for evaluating the physical stability of solid desiccant adsorbents when subjected to successive accelerated cycles of contact with hot aqueous solutions, and steam followed by rapid drying. The method of the invention can also be applied to evaluating the physical stability of other solid materials used as catalysts, e.g., refining catalysts.

An associated principal object is to provide a rating system based upon accelerated aging to reliably predict the relative useful life of solid adsorbents, catalyst supports and like manufactured articles subjected to cyclic wetting and drying processes during their service life.

Another object of the invention is to provide a method and apparatus for the accelerated aging of adsorbents of various shapes and sizes that provides relative physical stability information on the effect of size and shape of the particles in industrial service applications.

A further object of the invention is to provide an accelerated method and apparatus for determining the ability of the solid material to resist breakdown by contact with hot water or water-containing volatile component under conditions similar to those encountered in an industrial application. The test is designed to specifically evaluate the effect of water-soluble volatile components that are adsorbed with the water by the solid adsorbent during the dehydration process. Generally these volatile components, such as organic amines, are detrimental to the physical stability of the adsorbent.

It is also an object of the invention to provide an apparatus and method for improving the quality control that can also be utilized by the manufacturer of solid desiccant materials as an improved standard quality control test for production batches to provide data for grading each batch for purposes that can include warranting useful service life, replacement and maintenance schedules and product pricing.

Another object of the invention is to provide a means for establishing a quality control test for such materials to avoid production of sub-standard batches that would cause premature breakdown and excess fines formation when placed in operational service.

It is yet another object of the invention to provide a method and apparatus that can be used in evaluating the physical stability of solid catalysts, such as refining catalysts, that are subjected to process conditions that result in the eventual physical breakdown of the material. This breakdown reduces the effectiveness of the catalyst and adversely effects the efficient operation of the process.

As used herein, the term "adsorbent material" means any commercially manufactured solid desiccant material that can be used for dehydrating process steams. Examples include molecular sieves, activated aluminas and silicas employed in dehydration applications. These materials come in a variety of shapes, including beads and extrudates, and a variety of sizes (0.5–10 mm). It is also to be understood that "adsorbent material" includes any solid porous material, and particularly those that undergo exposure to heat and steam. This includes various shapes of manufactured articles, such as rings, branched cylinders, and the like which contain a catalyst, or which support a catalyst that are contacted by the process stream.

SUMMARY OF THE INVENTION

In its broadest aspect, the apparatus of the invention comprises a sample treatment chamber for containing a sample in a controlled environment that is isolated from ambient laboratory conditions. The treatment chamber is heated and has an associated cooling system for condensing water vapors withdrawn from the heated chamber. Also communicating with its interior are means for (a) the programmed delivery of a fluid to saturate the sample, which fluid can include water or an aqueous solution, and (b)

subjecting the sample to a vacuum to expedite the drying process. After a predetermined number of wetting and dying cycles, the sample is evaluated for physical degradation. The sample material is sieved or screened and any degraded material, or fines, that pass through a sieve or screen of specific pre-determined mesh size is weighed. The ratio of the weight of any fines to the original sample weight is determined, and is preferably and conveniently expressed as a weight percent. A zero percent value for a predetermined number of cycles is optimum and confirms that no fines have been formed during the test protocol and that the material is likely to have a strong resistance to breakdown when subjected to process regeneration cycles.

The apparatus and method of the invention require a relatively small sample of a commercial solid adsorbent material in the form of discrete manufactured beads or extruded material that are subjected to repeated cycles in a laboratory-scale test apparatus under conditions that will lead to the accelerated degradation of the material. The process of the invention includes saturating the sample with water or an aqueous solution containing one or more additives and rapidly drying it under conditions of high temperature and vacuum. The relatively short cycle time allows statistically significant data to be collected within two to ten days. The apparatus is automated and is easy to construct and to program for operation. In a preferred embodiment, constructed for simultaneous comparative testing of several different product samples.

In one preferred embodiment, 60 cycles of 24 minutes/cycle, are completed using samples of about 25 grams. After each 60 cycles, the sample is screened and any fines are weighed and the percentage of fines based on the original dry weight of the sample is recorded. It has been found that it is desirable to complete at least 120 cycles in order to provide sufficient data. Preferably, up to 600 cycles are completed with fines measurement after each 60 cycles to obtain data for making comparisons between competing commercial products when a reliable assessment of the product(s) having the greatest potential service-life is needed.

The chamber is heated to a temperature in the range of from 118° C. to 125° C. and preferably maintained at a temperature of about 122° C. A vacuum is preferably maintained to facilitate the drying and removal of water vapor. The water vapor is preferably condensed to facilitate the process.

The apparatus and method of the invention can be utilized to evaluate the ability of a material to resist breakdown after repeated cycles of exposure to environmental conditions similar to those encountered in industrial dehydration processes. The invention can be used by the industrial consumer of this material to identify the most suitable commercial material available.

The temperature, or temperature range, to which the test sample is subjected in the heated chamber does not necessarily closely replicate operating conditions in actual industrial dehydration processes. However, the higher temperature, or temperature range is similar to the conditions experienced by desiccant adsorbents during industrial regeneration processes. The preferred operating temperature, or temperature range has been determined to optimize the practice of the invention.

The water added to the sample is at ambient temperature. At the beginning of each of the cycles, the test sample is at about 122° C., its temperature is reduced with the initial contact of the saturating water or aqueous solution, is gradually raised to the temperature at which the water or aqueous solution begins to evaporate and generate steam, following which the dried sample approaches or attains the maximum temperature of the heated chamber. Since a relatively small sample can be utilized in the method and the apparatus of the invention, a uniform or steady-state condition can be attained within the preferred cycle of 24 minutes. Thus, upon the addition of water at ambient temperature, the temperature of the test sample is lowered from, e.g., 122° C., but the effects of the oven temperature and vacuum causes the water to be desorbed as steam, and the dry sample again reaches the stable interior temperature.

The particular size and/or shape of the material to be tested has not been found to have an effect on the practice of the invention. It is, of course, important to obtain representative samples of the commercial material to be tested. Sampling techniques for dry solids are well established in the art. This will be apparent to one of ordinary skill if each particle or piece of the material to be tested is relatively large, the number of pieces to be tested, and therefore the total starting weight of the sample may have to be adjusted accordingly to insure that a representative sample is subjected to the test.

From the description and example that follows, it will also be apparent that the invention can also be utilized by the manufacturer of materials subjected to repeated cycles of aqueous saturation and dehydration to establish an improved quality control standard for production batches and to provide a means for grading each batch for purposes that can include warrantying useful service life, replacement and maintenance schedules and product pricing.

BRIEF DESCRIPTION OF THE DRAWINGS

The apparatus and method of the invention will be described with reference to the attached drawings in which.

DETAILED DESCRIPTION OF THE PREFERRED EMBODIMENT

Figure 1:
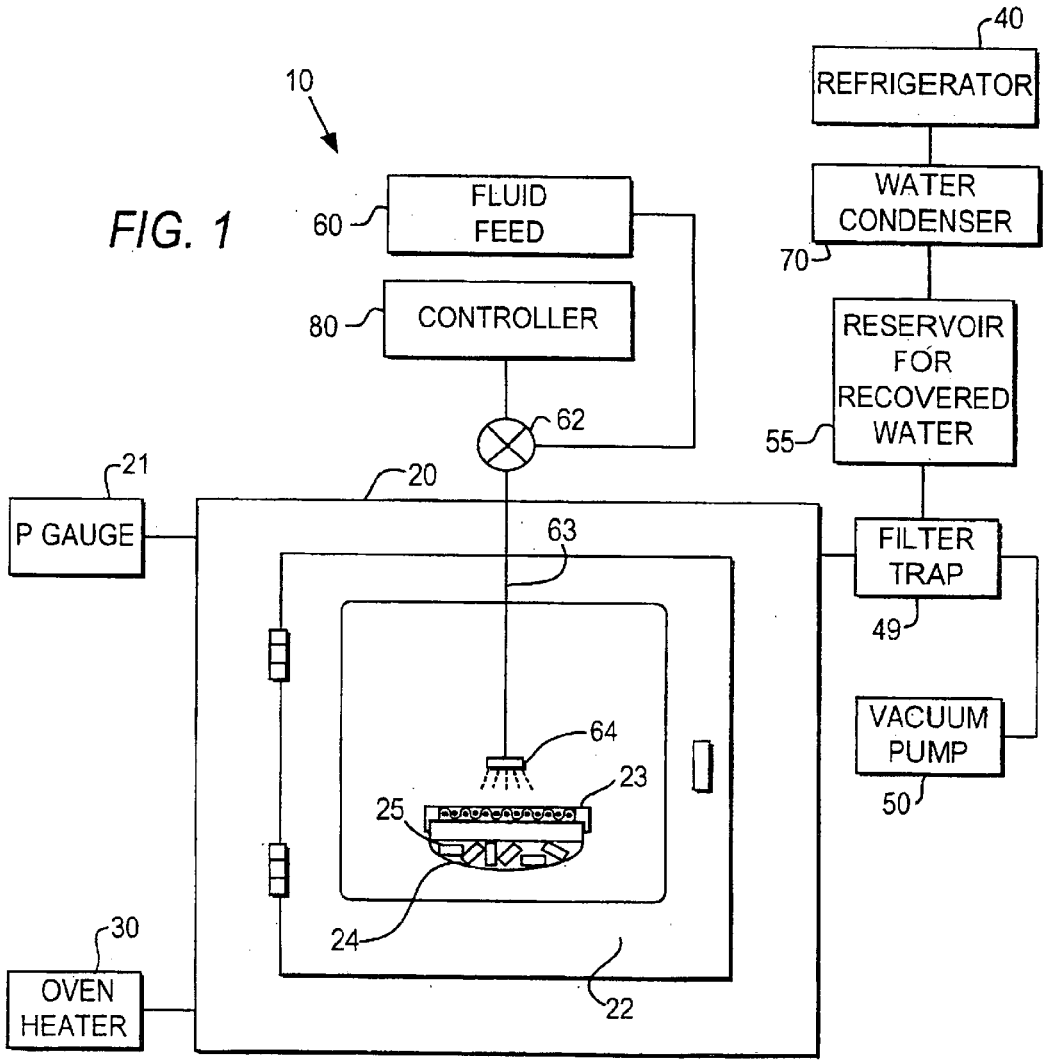
FIG. 1 is a schematic illustration of one preferred embodiment of the sample treatment chamber and its associated components.

With reference to the schematic illustration of FIG. 1, the accelerated degradation test apparatus referred to generally as 10 includes sample treatment chamber 20 and associated heating means 30, cooling means 40, vacuum means 50, fluid feed means 60 and vapor condenser 70. A programmable controller 80 is connected to the fluid feed in order to control the amount of fluid added and the length of the drying cycle. The duration of the time during which water or other fluid is added plus the drying time constitutes the total time for a single cycle. In a preferred test protocol, a cycle is 24 minutes, allowing 60 cycles to be completed in a 24-hour period.

The treatment chamber 20 is conveniently provided with access door 22 to facilitate the placement and removal of sample container 24 and solid sample material 25. Several different types of container have been studied. Most commonly used for routine testing is a concave stainless steel dish having a diameter of about 15 cm. Once the sample has been loaded into the dish, the dish is covered with a stainless steel mesh cover 23 to prevent the sample under test from being ejected from the dish during the test period. The fines 29 formed during the test are also prevented from being expelled from the dish by this mesh cover. The dish is placed directly below the nozzle of the tube through which water is periodically added to the sample by an automatic valve system. The dish is stationary during the test period, a sieve at the end of the test separates any fines being formed. An alternative sample container is described below in conjunction with FIG. 2.

With continuing reference to FIG. 1, the fluid feed means is provided with a valve 62, such as a Skinner valve sold by Honeywell, Inc., that is preferably operated by controller 80 to permit the controlled release of a predetermined volume of water or other liquid aqueous solution through conduit 63 communicating with the interior of chamber 20. The conduit 63 terminates in dispensing head 64 positioned above the sample 25. The volume of fluid dispensed is sufficient to fully saturate the sample particles to thereby replicate conditions experienced by particles during the regeneration process in an industrial dehydration process.

The cyclical test can be conducted with water alone, or with water in which one or more chemical additives have been dissolved. For example, if it is desired to establish a baseline in which the number of variables is minimized, distilled water can be used to saturate the material to be tested. Alternatively, the laboratory can be supplied with water of the type recovered from the adsorbent bed during the regeneration cycle in the operating plant. Hydrocarbon solvents or other chemicals likely to be encountered in the industrial process streams being treated can also be dissolved in the water to form the solution that is sprayed on the material to be tested. This exposure to fluids similar to those encountered on actual process conditions in the field are used to develop further comparative data that can be used in predicting useful life of the material, efficiency expectations and maintenance scheduling for the refinery or chemical production facility.

As will be understood, this data will be of great value to both the consumer and the manufacture of the adsorbent materials, catalyst supports and the like. The method of the invention provides a novel standard quality control test for a new shipment of material. As described above, the test can be limited to water and/or one or more additional test(s) can be performed to determine the effect of an added component that is adsorbed from the process stream with the water. For this latter test protocol, the component is dissolved in the water and the test conducted simultaneously or in parallel using multiple test chambers. The concentration of the component is estimated based on its concentration in the process stream to be dried.

Heater 30 can be any form of electric laboratory oven that is capable of maintaining the desired steady-state temperature and that can be operated under vacuum.

In order to subject the sample particles to accelerated wetting and drying cycles, in a preferred embodiment the apparatus includes a refrigeration cooler, capable of reducing the temperature of the vapors extracted from the sample chamber to about minus 80C. The water vapors extracted from the sample chamber are predominantly water and these condense to liquid water when they are passed over the cold surface of the refrigeration cooler. The condensed water is collected in the water reservoir.

In order to further accelerate the drying of sample particles, a vacuum is maintained in the chamber using vacuum pump 50, which communicates with the interior of chamber 20 via conduit 53 and intermediate valve 52. A suitable vacuum oven is the Precision Scientific Model 29, Haake Model DC 50; a suitable vacuum pump is the Edwards Model E-Lab 2 from Edwards in the U.K.

The programmable controller 20 can be a commercial device of the type known to the prior art having a plurality of timed, programmable switches for activating the various elements of the apparatus. A controller suitable for use in the invention is manufactured by Valco Instruments C. Inc. and identified as a Vici Digital Valve Sequence Programmer. In another preferred embodiment, a single controller 80 is connected for the simultaneous operation of two or more test devices. Thus, a plurality of comparative standardized tests can be undertaken on the same product, or on a number of competitive products. The reservoir for collecting condensed water can be constructed from Pyrex glassware components to include a condenser, flask and connectors. A trap is provided to prevent carry over of liquid or particulates from the condenser system to the vacuum pump.

Figure 2:
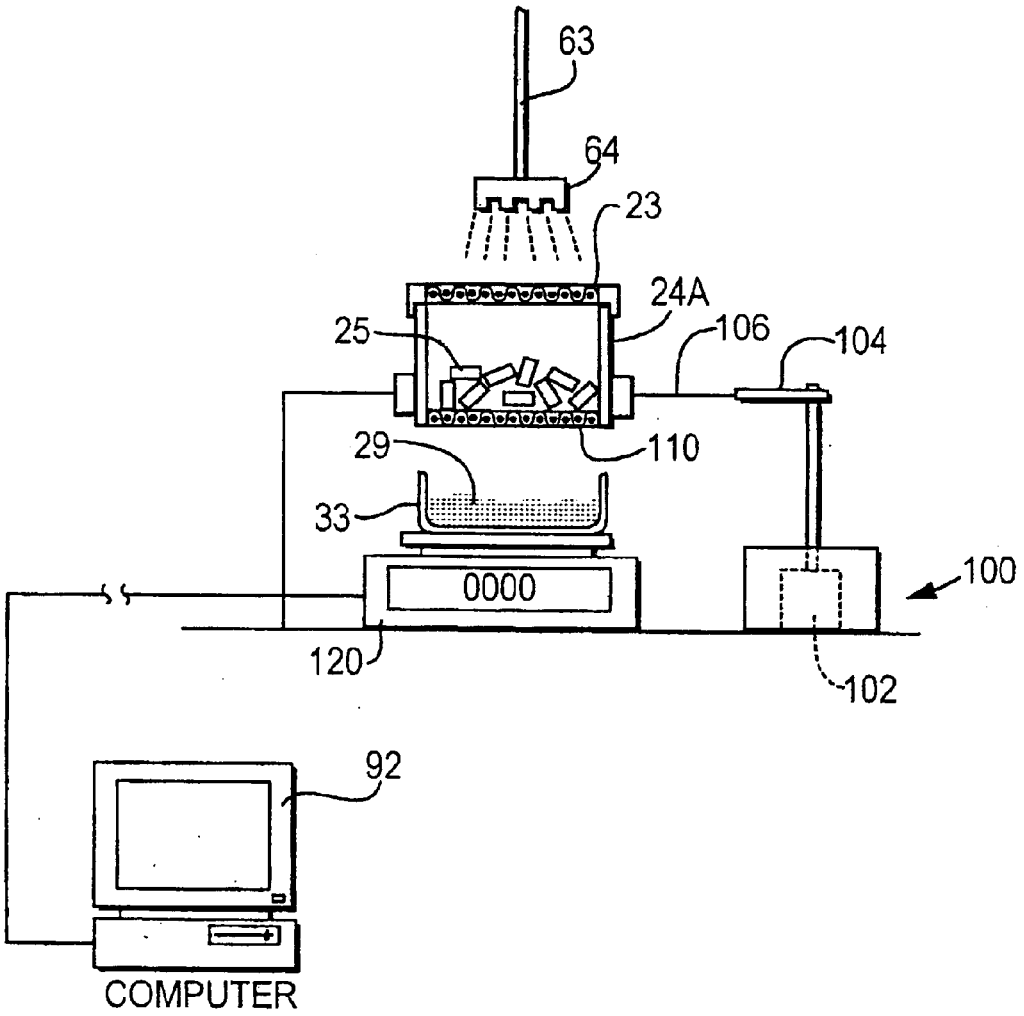
FIG. 2 is a schematic illustration similar to FIG. 1 showing another preferred embodiment of the invention.

In another preferred embodiment that will be described with reference to FIG. 2, the steps of separating and weighing of any fines released 29 from the test sample 25 is automated and conducted without removing the sample and its container from the heated chamber 20. In this embodiment, the apparatus includes a sample supporting screen 110 of the required mesh size, e.g. 8 mesh; an agitator mechanism 100 that can include a motor in housing 102, a rotor 104 to which is attached a connecting arm 106 that is operatively attached to the support screen 110 and/or the container to shake the sample 25 in container 24A and deposit any fines 29 into a tared receiving dish 33 below the container. The supporting screen 110 can be incorporated into the bottom of the container 24A. The agitator means is connected via cable 92 to controller 80.

In a particularly preferred embodiment, there is also provided a digital is scale or other electronic weighing means 120 for displaying and/or electronically recording the weight of any fines separated from the sample and deposited into the receiving dish following agitation. The weight measurement data is communicated to an appropriately programmed general purpose computer 130 to perform the calculation of any percentage change in weight from the original weight of the sample. It is to be understood that the periodic agitation of the sample can also have the effect of accelerating any tendency of the sample to degrade. The agitation can be programmed to occur when the sample is dry, and during each, or only a portion of the cycles.

The weight change percentage calculated after each predetermined number of cycles, e.g., after each 60 cycles, is recorded in the computer's memory for display and retrieval, and for comparison to any established standards for the particular type of sample material and for eventual final reporting on the evaluation of the material. It will be understood that the final report can be based upon any number of sample weighings between any number of cycles, e.g., ten weighing at 60 cycle intervals, for a total of 600 cycles.

The invention will be further described in connection with the following examples of tests on molecular sieves and adsorbents commonly used in removing water from process streams.

EXAMPLE 1

Molecular sieves from four commercial suppliers were evaluated using the method and apparatus of the invention. The molecular sieves were intended for use in gas dehydration in the petroleum industry. All four samples were of the is same extruded shape.

An apparatus of the type described above was employed to evaluate 25 gram composite samples of extruded particles of 3.2 mm diameter and having average lengths in the range of 4–6 mm. The weighed sample was contained in a concave stainless steel dish having a diameter of 15 cms and covered with a fine stainless steel mesh cover and placed in a heated oven maintained at a temperature of 122° C. The controlled automated valve sequencer was activated and added 20 ml volumes of water to the sample in successive cycles every 24 minutes providing 60 cycles per day. For comparison of different commercial products, the test is run for 10 days or 600 cycles and the levels of fines are measured after each 60-cycle period. At all times, the sample remains in the vacuum oven where the temperature is fixed at 122° C. Through the duration of each cycle, evolved water vapor is removed and condensed using a condenser maintained at minus 8° C. by a refrigerated chiller. The interior of the oven and sample container are maintained under a constant vacuum of about 30 inches of mercury by a vacuum pump.

Each of the samples was sieved, or screened, on an 8-mesh sieve and the weight-percent of fines material passing through the screen was determined after each 60 cycle-period to the maximum of 600 cycles.

Using the above procedure the following criteria were developed: a value of 0% fines after 600 cycles is deemed optimum. A breakdown or degradation rate of 3% is considered satisfactory; and a value of greater than 8% fines after 120 cycles provides a basis for rejection of the lot from which the sample was drawn.

Actual plant performance was found to correlate well with the criteria established using the laboratory method of the invention. A value of 0% fines corresponded to a product that had an excellent service life of five years. A product yielding a test value of 1% fines/120 cycles showed no significant backpressure build-up after 2.5 years of service life. Another product exhibiting a 10% rate of breakdown after only 120 cycles, for which an early failure in service was predicted, did in fact experience a premature failure after less than three years of service in a gas plant operating with a reduced gas throughput. After shutdown, it was confirmed that the failure was due to excessive formation of fines.

EXAMPLE 2

Adsorbents used to remove water from process streams also adsorb other components in the stream. In gas streams, volatile amines such as morpholine are also removed from the water. Morpholine is a volatile amine that can be present in the gas streams in gas plants. Previously, its effect on breakdown of molecular sieves was unknown. Analysis indicates that water adsorbed from gas streams contains 0.5–2% w/w morpholine. The presence of morpholine increases the rate of breakdown of the molecular sieve. Laboratory tests have shown that the rate of degradation of a sample of molecular sieve by a solution of water with 0.5% added morpholine is three times greater than that of water alone. Consequently, when there are other known additional components adsorbed from process streams, the accelerated degradation method and apparatus of this invention can determine the effect of this component on the breakdown rate of an adsorbent.

As demonstrated by the above example of actual operating experience, the apparatus and method of the invention provide an inexpensive, reliable and objective way of evaluating solid desiccant adsorbents for their ability to resist breakdown into fines after repeated cycles of hydration and regeneration. The practice of the invention can provide cost-savings to the user in the selection and purchase of the optimum material available in the market, extension of the service life of plant dehydrators and most importantly, avoiding unscheduled downtime that results from a premature failure of the desiccant adsorbent in the process equipment.

As will be understood by one of ordinary skill in the art, the practice of the invention can also be applied to predict the physical stability and relative useful life of molecular sieves, catalyst supports and other materials used to pack columns in industrial chemical processes.

It will also be understood from the above that the invention can also be utilized by the manufacturer of materials subjected to repeated cycles of aqueous saturation and dehydration as an improved quality control standard for production batches and to provide a means for grading each batch for purpose that can include warranting useful service life, replacement and maintenance schedules and product pricing.

Other modifications and variations of the method and apparatus of the invention will be apparent to those skilled in the art based upon the above description.

We claim:

1. A method for evaluating and characterizing the resistance to physical degradation of a representative test sample of a solid manufactured material used in industrial processes, the method comprising:

a. placing a sample of said test material in a heated treatment chamber maintained at a temperature in the range from 120° C.–125° C.;

b. saturating the material with a water or an aqueous solution;

c. drying the saturated adsorbent material by subjecting the sample to a reduced pressure atmosphere in the heated treatment chamber;

d. repeating steps (a) through (c) for a predetermined number of cycles, where the duration of each cycle is approximately the same;

e. sieving the sample at predetermined cycle intervals to separate any fines that have formed from the test material;

f. determining the percentage by weight of any fines separated as compared to the weight of the original test sample; and g. recording the information obtained in step (f).

2. The method of claim 1 which includes the further step of comparing the value of the weight-percentage determined in step (e) to a table of values indicating the relative physical stability of the adsorbent material.

3. The method of claim 1 where the sample is saturated with water.

4. The method of claim 1 where the heated saturated sample is dried under vacuum.

5. The method of claim 4 where the sample is subjected to a vacuum of about 30 inches of mercury.

6. The method of claim 1 where the extracted water vapor is condensed to liquid in a refrigerated condenser.

7. The method of claim 1 where the duration of each cycle is about 24 minutes.

8. The method of claim 7 where the sample is subjected to 600 cycles.

9. The method of claim 1 where the sample is selected from the group consisting of molecular sieves, activated alumina and silicas used in gas dehydration processes.

10. The method of claim 1 where any fines formed are separated from the sample by passing through an 8-mesh sieve.

* * * * *